United States Patent [19]

Goller et al.

[11] Patent Number: 4,703,630

[45] Date of Patent: Nov. 3, 1987

[54] FLAT-BED KNITTING MACHINE HAVING A CARRIAGE DISPLACEABLE INTO A POSITION FOR SERVICING

[75] Inventors: Ernst Goller; Udo Herman; Adam Müller, all of Reutlingen; Fritz Walker, Kusterdingen, all of Fed. Rep. of Germany

[73] Assignee: H. Stoll GmbH & Company, Fed. Rep. of Germany

[21] Appl. No.: 914,240

[22] Filed: Oct. 2, 1986

[30] Foreign Application Priority Data

Oct. 5, 1985 [DE] Fed. Rep. of Germany ..... 3535672

[51] Int. Cl.[4] ..... D04B 7/04

[52] U.S. Cl. ..... 66/64

[58] Field of Search ..... 66/64, 60, 168

[56] References Cited

U.S. PATENT DOCUMENTS 4,583,380 4/1986 Schimko ..... 66/64

*Primary Examiner*—Ronald Feldbaum

*Attorney, Agent, or Firm*—Jones, Tullar & Cooper

[57] ABSTRACT

A flat-bed knitting machine is described which has a carriage apparatus movable along a needle bed apparatus, a front machine frame on which the needle bed apparatus is held and which includes at least one projecting part, and on each end a plurality of yarn eyes for supplying yarn to the needle bed apparatus. To make it possible to perform servicing and/or repair work on the underside, that is, in the cam area of the carriage apparatus without major effort or long stoppages, a protective cover receiving the plurality of yarn eyes is provided on one end of the needle bed apparatus, and this cover, when the machine is not in operation, is movable, along with the carriage apparatus contacting it on one side, by a predetermined displacement distance into an outer position in which the carriage apparatus is located partly on a projecting part of the front machine frame on the far side of the needle bed apparatus and there is freely accessible from below.

25 Claims, 7 Drawing Figures

FLAT-BED KNITTING MACHINE HAVING A CARRIAGE DISPLACEABLE INTO A POSITION FOR SERVICING

FIELD OF THE INVENTION

The invention relates to a flat-bed knitting machine having a carriage apparatus movable along a needle bed apparatus, having a front machine frame on which the needle bed apparatus is retained, and having a large number of yarn eyes, for supplying the yarn, on both ends.

BACKGROUND OF THE INVENTION

In flat-bed knitting machines, access to the cam elements of the carriage apparatuses for servicing or repair work, if problems arise at some cam element, is difficult. In known flat-bed knitting machines of this type, it is necessary to perform various manipulations and cut the supplied yarns, and then to lift the carriage apparatus with an auxiliary technical apparatus, in order to see beneath it. In other known flat-bed knitting machines, again after various manipulations and cutting of the supplied yarns, the carriage apparatus can be pushed onto a table provided at one end of the needle bed apparatus so that the cam elements on the underside of the carriage apparatus can be looked at. In both cases, this results in considerable stoppage times and considerable labor, using several persons. This considerable effort is generally justified in only a very small number of cases of malfunction, whenever relatively major repair work is necessary. In most cases, however, such malfunctions can be taken care of with simple and quickly-performed manipulations.

SUMMARY OF THE INVENTION

It is an object of the present invention to provide a flat-bed knitting machine of the above general type in which servicing and/or repair work on its underside, that is, in the cam area of the carriage apparatus, can be done without involving major effort or long stoppages.

This object is attained by providing a protective cover on at least one end of the needle bed apparatus, which receives the large number of needle eyes and can be moved into an outer position when the machine is not in operation, in the manner described herein.

The provisions according to the invention make it possible in a simple manner to move the usually multi-system carriage apparatus into an outer position in which its entire underside—that is, all the cam elements—is readily accessible so that servicing or repair work can be performed. All that needs to be done to this end is that the protective cover be displaced a certain distance outward; it is not necessary to cut the supplied yarns, which can remain in position, merely being lengthened somewhat, when the lateral protective cover is moved outward, by becoming unwound from the yarn spool and/or by the tightening of a yarn tension device which may be present. In a simple manner, it becomes possible to extend the idle travel of the carriage apparatus for this special position, without having to lengthen the machine overall, which would be particularly disadvantageous in terms of packing, of shipping costs, of the cost for material and hence production costs, of weight, and so forth. The distance the protective cover has to be moved outward is relatively short, because it needs to be only just long enough that in this outer position the carriage apparatus comes completely free of the needle bed apparatus.

According to an exemplary embodiment of the present invention, the projecting part supporting the carriage apparatus in its outer position is embodied by a frame, the central recess of which has a width approximately equal to that of the carriage apparatus, thereby providing a simple structural means for access to the underside of the carriage apparatus.

According to a further exemplary embodiment, an equipment box, preferably in the form of a switch cabinet, is disposed underneath the projecting part and is movable on the front machine frame out of the region of the projecting part, preferably being held such that it can be pivoted outward by 90°. On the one hand, the equipment box for the programmed triggering of the flat-bed knitting machine is thereby integrated into the machine frame, and on the other hand, this assures that it will not hinder access to the underside of the carriage apparatus when the latter is in the servicing or repair position.

Usually, in a flat-bed knitting machine the carriage apparatus is guided on preferably a front and a back carriage guide bar by means of front and back end bearing pairs, preferably roller bearing pairs. For the above-mentioned outer position, it would then be possible when pulling out the protective cover to extend the carriage guide bars in a telescoping manner. According to a preferred exemplary embodiment of the present invention, however, the carriage apparatus is provided with one or more front pairs and one or more back pairs of auxiliary bearings, which are disposed in a region between the end bearing pairs and which rest on the carriage guide bars only in the outer position of the carriage apparatus, assuming the function of the leading bearing pairs. In other words, these auxiliary bearings do not come into play during normal operation, but only if the carriage apparatus is moved into this outer position, or servicing or repair position. In order to accomplish this, it is suitable for the bearing surface of the auxiliary bearings to be offset relative to those of the end bearings, preferably by approximately 2/10 mm.

In another kind of situation, it is also possible for the auxiliary bearings to travel continuously along with the others, which has the advantage of a longer service life and of a non-jerking transition when moving into the operating position.

In flat-bed knitting machines provided with a suppressor cam system, or in which the cam elements of the carriage apparatus can be adjusted only electromagnetically and the carriage stroke can be adjusted electrically, it suffices to provide the protective cover optionally, in addition to the yarn eyes, with a correspondingly large numer of yarn tensioning devices. However, if the carriage apparatus of a flat-bed knitting machine is embodied such that the cam elements, such as the needle retraction elements, are indexed mechanically at the carriage reversal point, then it is suitable to provide the inside of the protective cover with preferably adjustable stops for indexing the cam elements.

In an exemplary embodiment of the present invention, the protective cover is adjusted with the aid of preferably two spaced-apart guide bars, which are displaceably guided in guide sleeves secured in the projecting part. To assure that the flat-bed knitting machine cannot be switched on or will not be turned off when the protective cover has been or is displaced out of the position it normally assumes, the protective cover suitably cooperates with a safety switch, preferably in the form of a contactless proximity switch.

For simple and quick release and reconnection of the protective cover from and to the machine frame, the machine frame is connected to the projecting part by means of a preferably adjustable, releasable detent connection.

The protective cover becomes easy to manufacture and yet is mechanically sturdy if it is provided with a reinforcing skeleton, preferably made from an aluminum profile section, on the outside of which a hood element completely covering it and preferably in the form of a deep-drawn plastic part is secured. The skeleton serves to receive the various elements, such as guide bars, yarn tensioning stops and the like, while the hood element is provided with a preferably central depression in which the yarn eyes are retained.

Further details and features of the invention will become apparent from the ensuing description of an exemplary embodiment, taken in conjunction with the drawings.

DESCRIPTION OF THE PREFERRED EMBODIMENT

Figure 1:
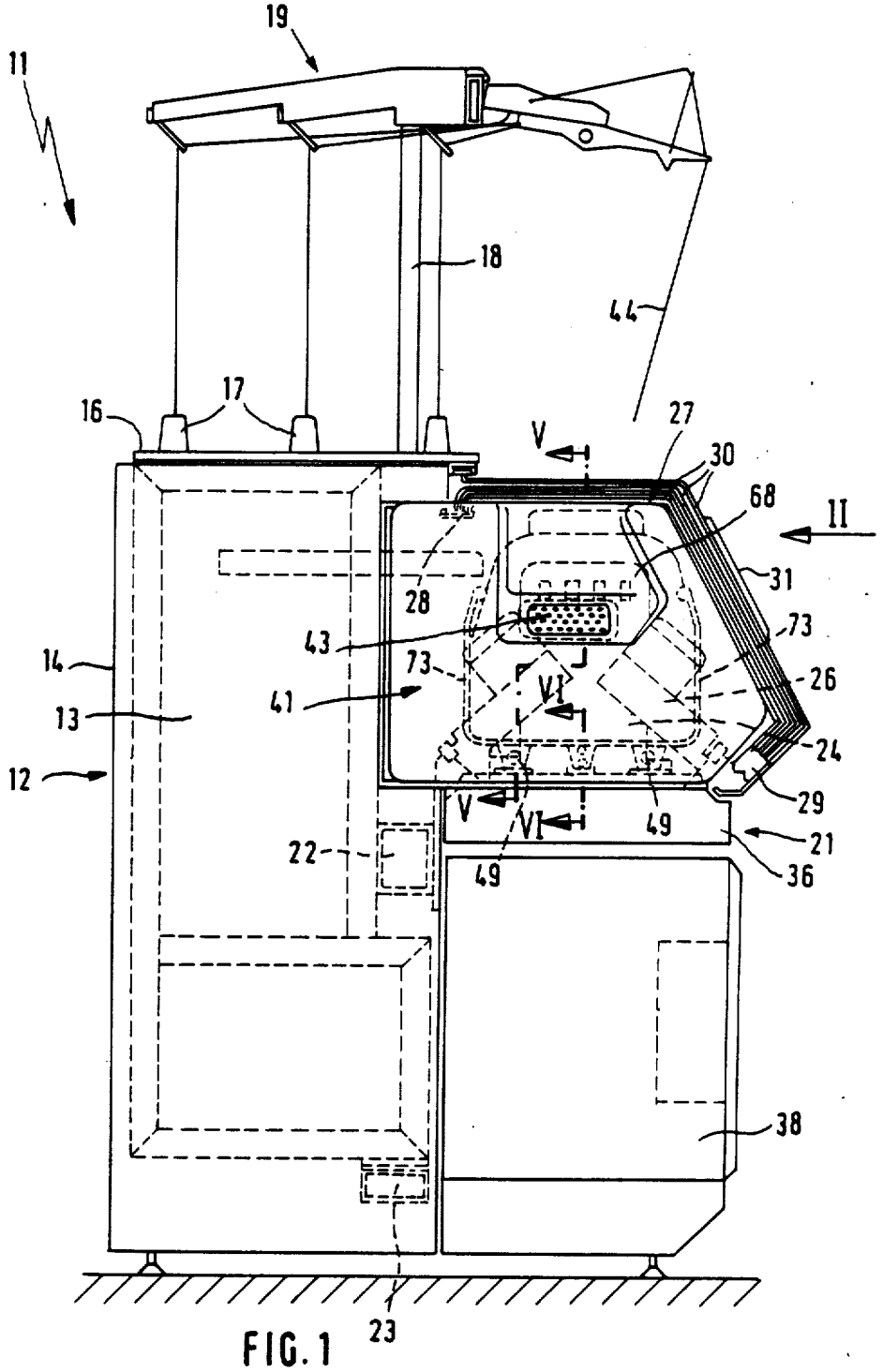
FIG. 1 is a schematic side view of a flat-bed knitting machine according to a preferred exemplary embodiment of the present invention.
Figure 3:
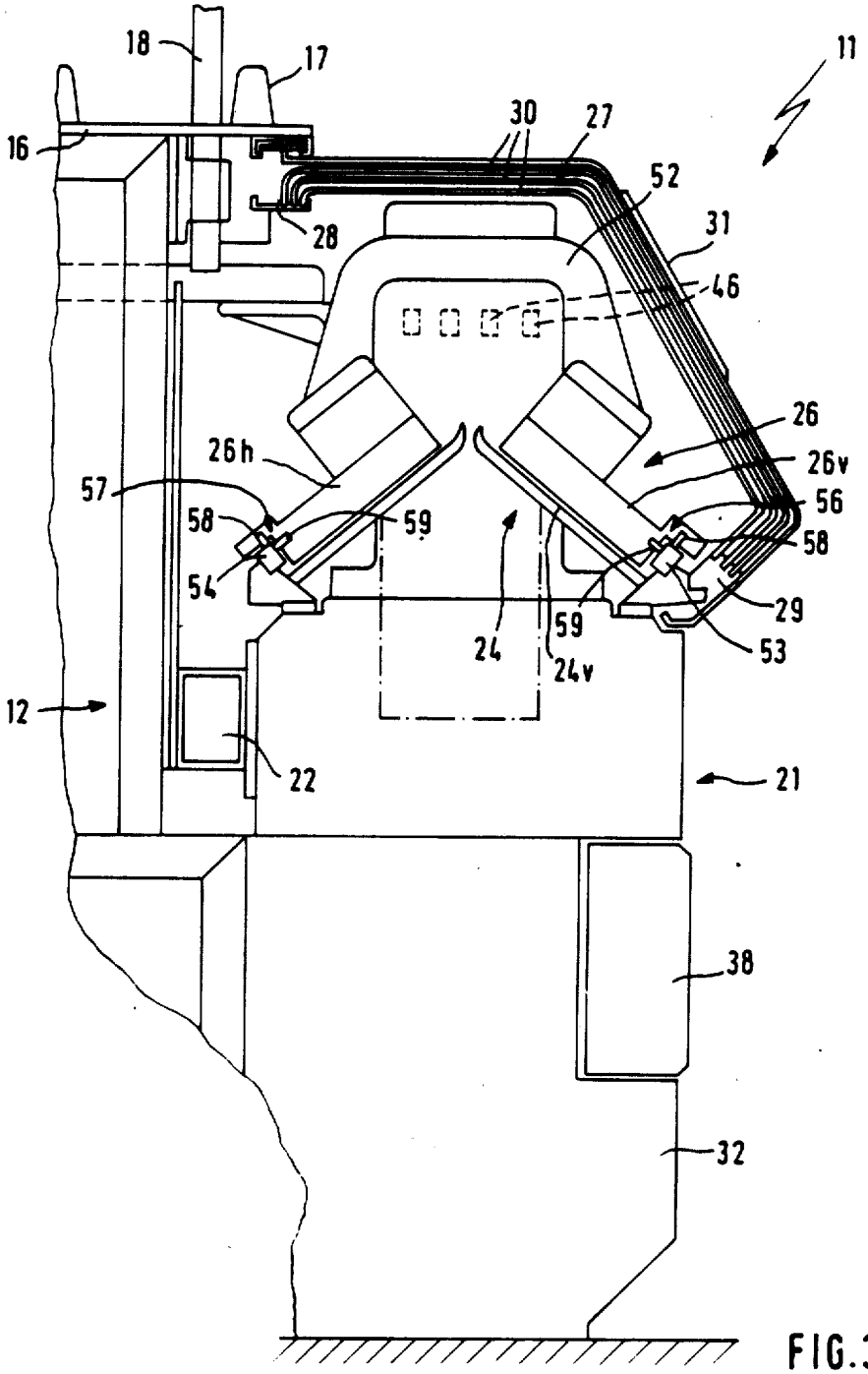
FIG. 3 is a partly broken-off view taken along the line III—III of FIG. 2A.

The flat-bed knitting machine 11 shown in the drawing and in accordance with a preferred exemplary embodiment of the present invention has a back machine frame 12, covered toward the back with respect to the outside by side and rear housing wall parts 13, 14, on which a spool table 16 for spools 17 of yarn is secured, as shown in FIGS. 1 and 3. The back machine frame 12 also has a yarn supply means 19, which is provided with yarn guides, yarn tensioning devices, yarn brakes and the like in a manner shown only schematically, and which is supported on two lateral, vertical retaining bars 18.

Connected to the back machine frame 12, by means of at least one middle and one lower lengthwise carrier 22, 23, is a front machine frame 21, which supports a lengthwisetraveling V-shaped needle bed apparatus 24, on which a carriage apparatus 26 is guided such that it is movable back and forth lengthwise. The needle bed apparatus 24 and the carriage apparatus 26 are covered at the front and top by a transparent covering 27, which comprises a plurality—preferably six—of covering hoods 30 that are movable beside one another over substantially the entire machine length and preferably in three parallel tracks, being held in an upper lengthwise guide 28 in the vicinity of the front long edge of the spool table 16 and on a lower lengthwise guide 29 in the vicinity of the front edge of the front needle bed 24 *v*. In a further track of the lengthwise guides 28 and 29, an input keyboard 31 retained on a suitably shaped narrow plate is also guided in a longitudinally movable manner before the covering 27.

Figure 4:
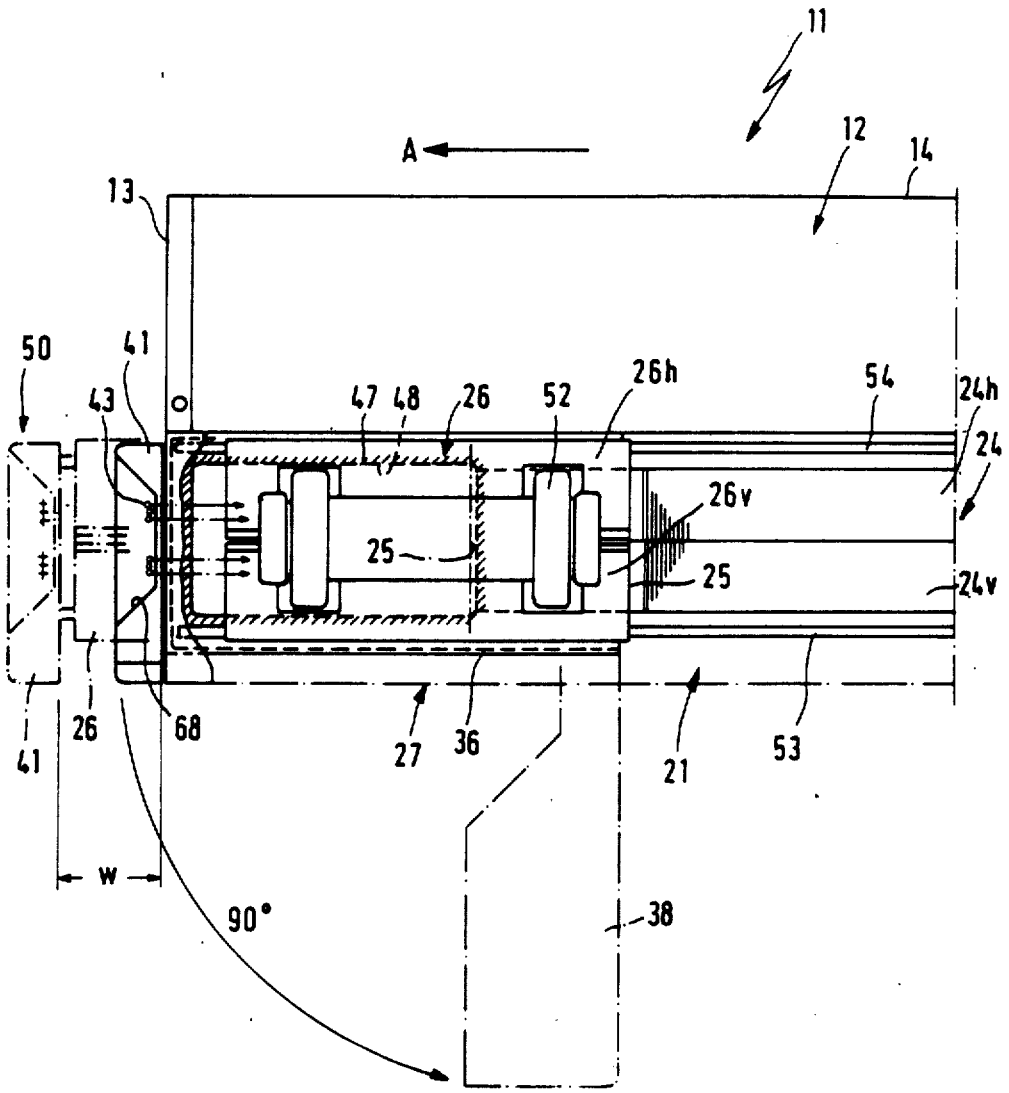
FIG. 4 is a schematic plan view of the portion of the flat-bed knitting machine shown in FIG. 2A, with the equipment box swiveled outward.

Seen in front view (FIGS. 2A and 2B), the front machine frame 21 has two spaced-apart vertical supports 32, 33 extending over its depth, each provided in a respective end area of the needle bed apparatus 24. The supports 32, 33 are connected by a horizontal frame 34, on which the needle bed apparatus rests. In the vicinity of the two regions of stroke reversal of the carriage apparatus 26 on the needle bed apparatus 24, the front machine frame has respective projections 36 and 37, extending from the respective supports 32, 33 and extending substantially as far as the respective end of the machine. Below each projection 36, 37, there is an equipment box 38, 39 extending over a substantial portion of this space between the projection and the support and secured to the respective horizontal support 32, 33. While the equipment box 39 is disposed in a stationary manner on the support 33 associated with it, and for example contains the drive, gears, mechanical control elements for the needle bed offset and the like, the equipment box 38 is supported on the support 32 such that it can be swiveled 90° to the front, as shown in FIG. 4. This equipment box 38 for instance contains electronic components for programmed triggering of the flat-bed knitting machine in accordance with knitting patterns as well as electronic components for storing and processing pattern data in the cam system and the like.

Figure 2A:
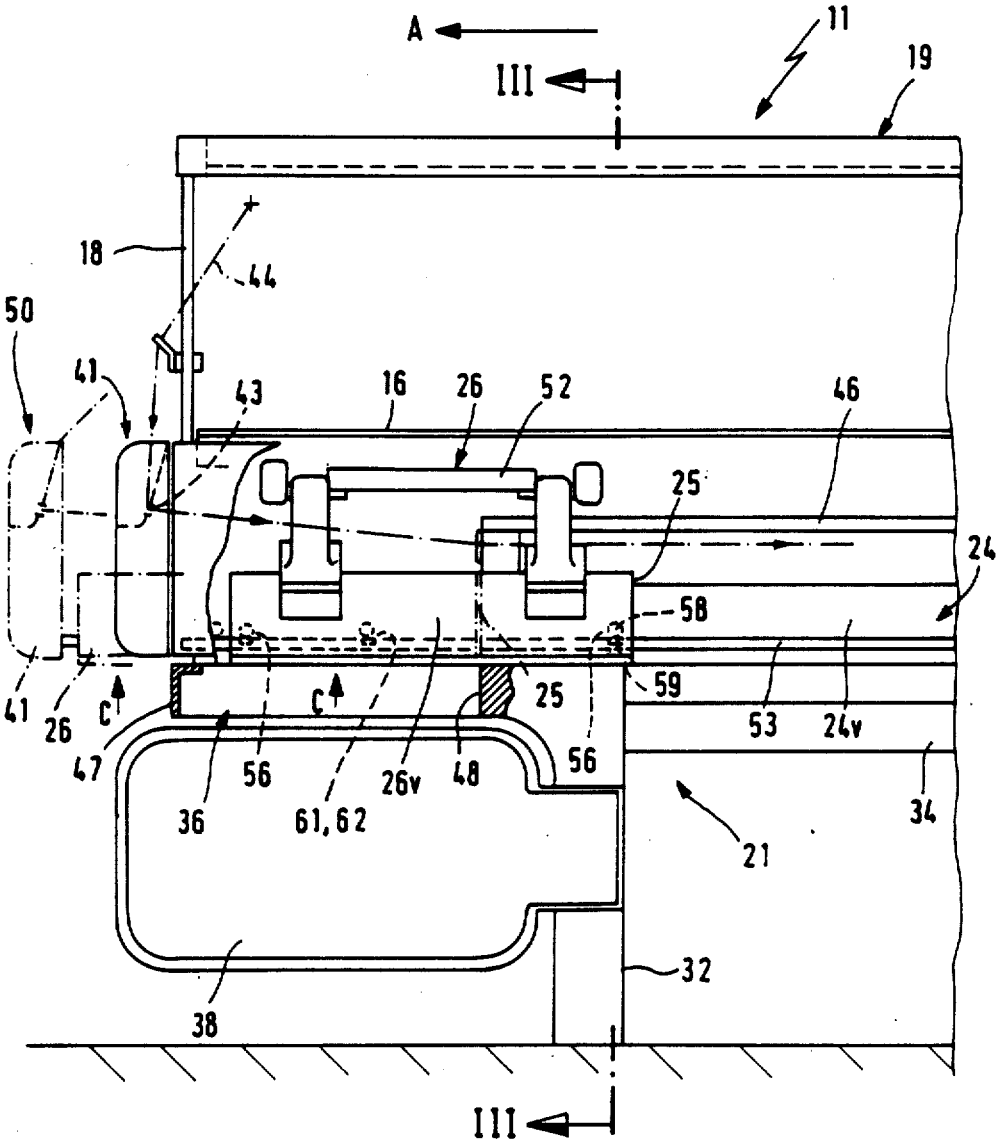
FIGS. 2A and 2B are schematic views, broken off in the middle, of the front of the flat-bed knitting machine taken along the arrow II of FIG. 1.
Figure 2B:
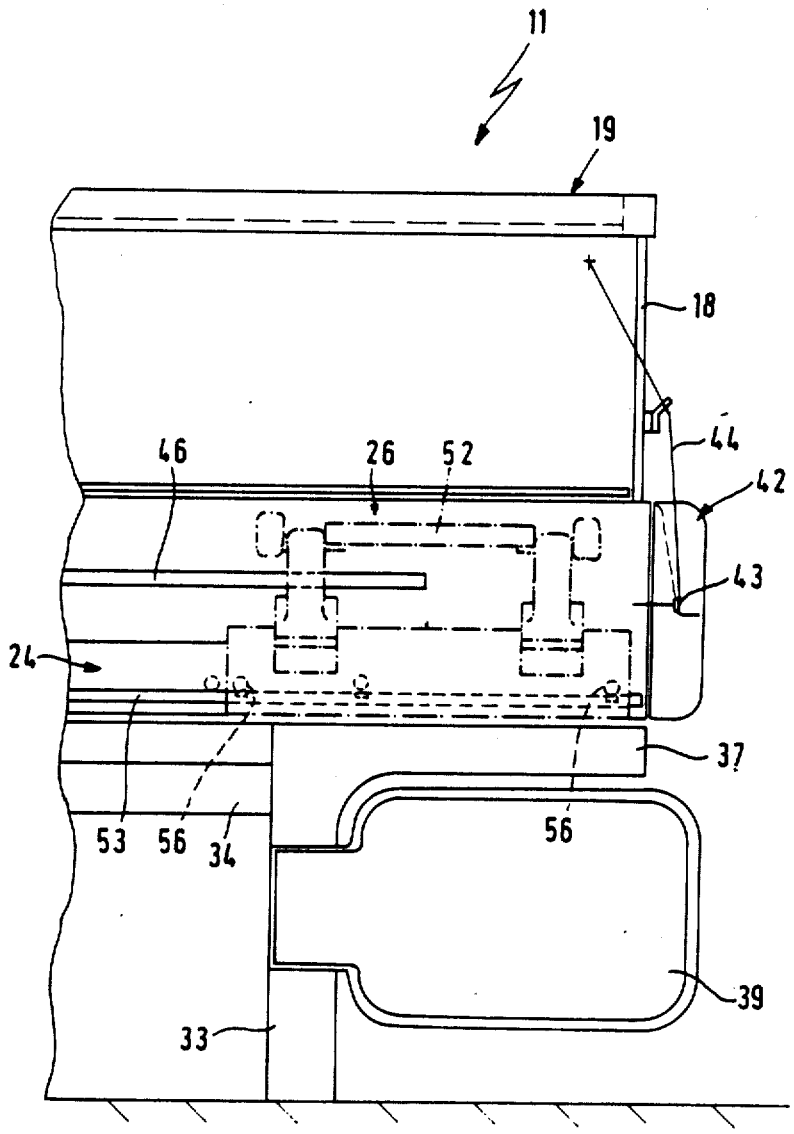

Both ends of the flat-bed knitting machine 11 are covered in the vicinity of the needle bed and carriage apparatus 24, 26 by a protective cover 41 and 42, respectively; the protective cover 42 is disposed in a stationary manner, while the protective cover 41, as shown in FIGS. 2A and 4, is movable outward, that is, in the direction of movement of the carriage apparatus 26, by a predetermined travel distance w. As FIG. 1 shows, the protective cover 41, and the protective cover 42 in like fashion, is disposed in a region between the underside of the needle bed apparatus 24 or the top of the projection 36 and the inside of the horizontal portion of the covering 27, on the one hand, and between the inside of the back machine frame 12 and the inside of the two inclined portions of the covering 27, on the other. The lateral protective cover 41 or 42 has a large number of yarn eyes 43, through which the yarns 44 pass from the yarn supply means 19 to the yarn guides (not shown), which are disposed such that they are longitudinally movable on yarn guide rails 46. The protective covers 41 and 42 may also have yarn tensioning devices, not shown, on their outside.

Figure 5:
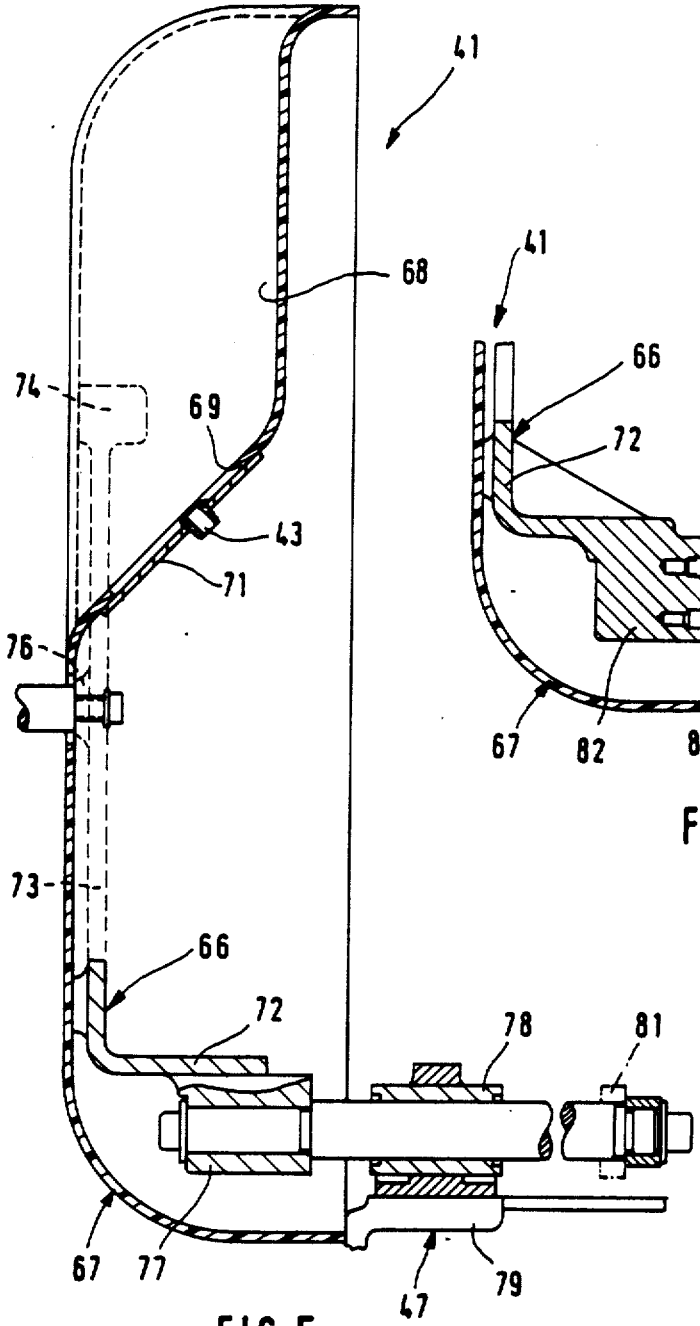
FIG. 5 is a sectional view taken along the line V—V of FIG. 1.
Figure 6:
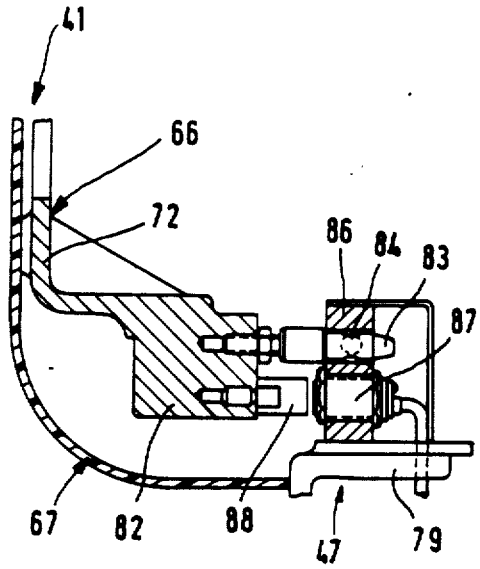
FIG. 6 is a sectional view taken along the line VI—VI of FIG. 1.

In FIGS. 2A and 4, solid lines indicate the position that the carriage apparatus 26 assumes during the left-hand stroke reversal. In this stroke reversal position, although the carriage apparatus 26 is located with its trailing cam element (in terms of the travel direction A) on the far side of the last needle in the needle bed 24, nevertheless it is not yet completely free of the V-shaped needle beds. In addition, a substantial portion of the carriage apparatus 26, which trails in the travel direction A, is disposed above the support 32 and the beginning of the projection 36. Thus this region of the underside of the carriage apparatus 26, in this stroke reversal position, is inaccessible from below. All that would be accessible in this position would be a front region of the underside of the carriage apparatus 26, because of the fact that the projection 36 comprises a frame 47 made of corner profile sections, having a central recess 48 the width of which is approximately equal to that of the carriage apparatus 26 but in any case is at least as wide as the region of the carriage apparatus 26 in which the cam system is disposed (see FIG. 4). In order now to provide that the entire underside of the carriage apparatus 26, which carries the cam elements and needle slots and the like, will be completely accessible from below, without having to lift the carriage apparatus 26 away from the needle bed apparatus 24, first the equipment box 38 is pivotable out of the region of the recess 48 of the projection 36, and second the protective cover 41 is movable or displaceable into an outer position shown in dot-dash lines in FIGS. 2A and 4. As also shown in FIGS. 5 and 6, the protective cover 41 is displaceable by means of two parallel guide bars 49 on the front machine frame 21 in a lower region of the needle bed apparatus 24. This displacement of the protective cover 41 by the distance w into the outer position can be done along with the guided yarns 44.

Either after the displacement of the protective cover 41 into the outer position shown in dot-dash lines or at the time of this displacement, the carriage apparatus 26 can also be moved or displaced outward past its stroke reversal position. This outer position 50, or servicing and/or repair position, of the carriage apparatus 26 is shown in FIGS. 2A and 4, partly also in dot-dash lines. The displacement distance w of the protective cover 41 and of the carriage apparatus 26 out of the operational reversal position into the outer position 50 is long enough that the back end 25 of the carriage apparatus 26 is disposed just inside the recess 48 of the projection 36. In this manner, with the equipment box 38 pivoted, the entire underside of the carriage apparatus 26 can be viewed from underneath along the arrows C, either through the recess 48 of the projection 36 or on the far side thereof.

The structural provisions for displacing the carriage apparatus 26 into the above-described outer position 50 are as follows:

Typically, the front and back carriages **26*v* and 26*h* of the carriage apparatus 26, which are joined together on their facing long sides by a rigid shackle 52, are guided on their front long edges on carriage guide bars 53 and 54, which are each held stationary in a respective region before the long edge of the respective needle bed 24*v*, 24*h* of the needle bed apparatus 24 on the front machine frame 21 (FIG. 3). The guidance of the carriage apparatus 26 is typically effected on respective ends by front and back roller pairs 56, 57, the rollers 58, 59 of which are disposed approximately at right angles to one another and roll on tracks, similarly disposed at right angles to one another, of the carriage guide bar 53, 54. Since the carriage guide bars 53,54 extend only as far as the respective ends of the front machine frame 21, and thus in the servicing or repair position of the carriage apparatus 26 the leading roller pairs 56, 57 are located outside the carriage guide bars 53, 54 and thus no longer rest thereon, additional or auxiliary roller pairs 61, 62 are disposed in a region that is closer to the roller pairs 56, 57 that are in the leading position in the direction A, or in a middle region of the carriage apparatus; these auxiliary roller pairs are disposed such that their bearing or rolling plane is higher, by preferably approximately 2/10 mm, than the planes of the main roller pairs 56, 57, and thus these front and back auxiliary roller pairs 61, 62 do not rest on the tracks of the carriage guide bars 53, 54 during normal or working operation of the flatbed knitting machine 11. These auxiliary roller pairs 61, 62 do not come into play, or in other words serve as bearings for the carriage apparatus 26, until with the displacement of the carriage apparatus into the above-mentioned outside position 50 the leading front and back main roller pairs 56, 57 reach an outward position beyond the end of the carriage guide bars 53, 54. In other words, the carriage apparatus 26, in this movement range and in the outer position 50 shown in dot-dash lines, is guided and held on the carriage guide bars 53, 54 by means of the trailing main roller pairs 56, 57 and by the auxiliary roller pairs 61, 62**.

If the carriage apparatus 26 is driven with the aid of a chain drive, then it is disengaged from the chain drive before being moved, for instance by hand, into its outer position.

In FIG. 5, the structural design of the lateral protective cover 41 is shown, and this applies to the protective cover 42 as well except for the possibility of being displaced. The protective cover 41 is composed of a basic skeleton frame 66, of preferably aluminum profile construction, and a hood element 67 preferably made as a deep-drawn plastic part, which is secured on the outside of the skeleton frame 66 and covers it on all sides. The hood element 67 has a depression 68 in its upper region (see FIGS. 1 and 4 also), which extends over only part of the width of the hood element 67 and in which the yarn eyes 43 are retained. To this end, the hood element 67 has a recess 69, in which a plate 71 carrying the large number of yarn eyes 43 is secured. This depression 68 in the hood element 67, which is open at the top, thus enables the free supply of the yarns 44 from the overhead yarn supply means 19. The skeleton 66, which serves as a reinforcement and for holding various elements, such as the guide bars 49, yarn tensioning devices (not shown) and optionally stops (if mechanically indexable cam elements are provided in the carriage apparatus 26), has a lower, crosswise corner element 72, on the two lateral ends of which upwardly projecting arms 73 are molded on; the arms 73 have a fastening eye 74 on their upper free ends, which are disposed approximately at the height of the yarn eyes 43. The arms 73 are also provided, in a middle portion, with respective further fastening eyes 76, on which yarn tensioning devices, for instance, can be secured. The upper fastening eye 74 serves to retain the hood element 67.

In the vicinity of the two lateral ends, on the underside of the corner element 71, there are respective molded-on protrusions 77, in which the respective guide bars 49, which extend in the direction of the front machine frame 71, are retained. Both parallel guide bars 49 are supported such that they are displaceably guided in a sleeve 78, which is secured to the top of the crosswise portion 79 of the corner profile frame 47 of the projection 36. The free end of the guide bar 49 is optionally provided with a stop face, which cooperates with a stop face, not shown, of the carriage apparatus 26, so that when the carriage apparatus 26 is moved outward into the outer position shown in dot-dash lines, the protective cover 41 is carried along with it. The free end of the guide bars 49 also has a limiting stop 81, which upon attainment of the above-mentioned outer position 50 meets the sleeve 78.

As shown in FIG. 6, a further molded-on protrusion 82 is provided between the two guide bars 49 or the molded-on protrusions 77; the protrusion 82 is provided with a vertically offstanding detent pin 83, which can engage a detent recess 84 of a structural part 86 that is likewise secured to the top of the crosswise portion frame portion 79 of the projection 36. In the working position, the protective cover 41 is retained by this detent connection 83 and 84, which is preferably adjustable. In the same structural part 86, there is a contactless proximity switch means 87, while in the protrusion 82 a counter-plate 88 is secured; this plate cooperates with the proximity switch 87 in such a manner that whenever the protective cover 41 is located in its locked-in working position, the switch 87 enables operation of the flat-bed knitting machine. If the protective cover 41 is displaced outward, out of its detent position into the outer position 50, then the proximity switch 87 causes the flat-bed knitting machine 11 to be electrically shut off, optionally except for permitting it to be driven until it reaches the outer position.

What is claimed is:

1. A flat-bed knitting machine, comprising:

a front machine frame including at least one projecting part;

a needle bed apparatus supported on the front machine frame;

a carriage apparatus mounted to the needle bed apparatus for movement therealong; and a protective cover connected to at least one end of the needle bed apparatus, said protective cover having a plurality of yarn eyes formed therein through which yarn is supplied to the needle bed apparatus, wherein:

the projecting parts extend outwardly from an associated end of the front machine frame in the direction of movement of the carriage apparatus:

the protective cover is movable along with the carriage apparatus in contact therewith, when the machine is not in operation, along an associated projecting part to define an outer position for the carriage apparatus material to the needle bed apparatus; and the carriage apparatus is freely accessible from its underside when in said outer position.

2. The flat-bed knitting machine as defined in claim 1, further wherein:

each projecting part comprises a frame having a central recess the width of which is approximately equal to that of the carriage apparatus.

3. The flat-bed knitting machine as defined in claim 1, further comprising:

an equipment box mounted to the front machine from below an associated projection part such that it is movable out of the vicinity of its associated projecting part.

4. The flat-bed knitting machine as defined in claim 3, further wherein:

the equipment box is pivotable toward the front of the machine by an angle of approximately 90° .

5. The flat-bed knitting machine as defined in claim 1, further comprising:

a pair of spaced apart, parallel guide bars;

front and back main end bearing pairs mounted to the carriage apparatus for guiding the carriage apparatus on the guide bars; and at least one front and at least one back pair of auxiliary bearings, mounted to the carriage apparatus between the main end bearing pairs, further wherein:

in said outer position, the auxiliary bearing pairs rest on said guide bars and assume the function of the leading main end bearing pairs.

6. The flat-bed knitting machine as defined in claim 5, further wherein:

the main end bearing pairs comprise roller bearing pairs.

7. The flat-bed knitting machine as defined in claim 5, further wherein:

the bearing faces of the auxiliary bearings are offset from the guide rails relative to the bearing faces of the main end bearings by approximately 2/10 mm.

8. The flat-bed knitting machine as defined in claim 5, further wherein:

the auxiliary bearings are mounted to the carriage apparatus centrally between the main end bearing pairs.

9. The flat-bed knitting machine as defined in claim 5, further wherein:

the auxiliary bearings are mounted to the carriage apparatus relative to the main end bearing pairs such that in said outer position the auxiliary bearings are situated adjacent to the end of the guide bars.

10. The flat-bed knitting machine as defined in claim 1, further comprising:

a plurality of yarn tensioning devices provided on the outside of the protective cover.

11. The flat-bed knitting machine as defined in claim 1, further comprising:

means provided inside the protective cover for indexing cam elements of the machine upon a stroke reversal of the carriage apparatus.

12. The flat-bed knitting machine as defined in claim 11, further wherein:

said means for indexing are adjustable.

13. The flat-bed knitting machine as defined in claim 1, further comprising:

a pair of spaced apart parallel guide bars; and a guide sleeve for each guide bar mounted to a projecting part for displacably guiding its respective guide bar, further wherein:

the protective cover is mounted to the guide bars.

14. The flat-bed knitting machine as defined in claim 1, further comprising:

a safety switch which is operatively associated with the protective cover.

15. The flat-bed knitting machine as defined in claim 14, further wherein:

the safety switch comprises a contactless proximity switch.

16. The flat-bed knitting machine as defined in claim 1, further comprising:

a releasable detent connection for connecting the protective cover with an associated projecting part.

17. The flat-bed knitting machine as defined in claim 16, further wherein:

the releasable detent connection is adjustable.

18. The flat-bed knitting machine as defined in claim 1, further wherein:

the carriage apparatus includes a stopping face; and the protective cover includes at least one adjustable stop which cooperates with the stopping face of the carriage apparatus for attaining said outer position.

19. The flat-bed knitting machine as defined in claim 1, further wherein:

the protective cover comprises a skeleton frame and a hood element covering the skeleton frame and secured thereto.

20. The flat-bed knitting machine as defined in claim 19, further wherein:

the skeleton frame comprises an aluminum profile construction.

21. The flat-bed knitting machine as defined in claim 20, further wherein:

the hood element is formed of a deep-drawn plastic.

22. The flat-bed knitting machine as defined in claim 1, further comprising:

a pair of spaced apart parallel guide bars to which the protective cover is mounted, further wherein:

the protective cover comprises a skeleton frame and secured thereto, said guide bars being secured to the skeleton frame; and the hood element incudes a depression in which the yarn eyes are retained.

23. The flat-bed knitting machine as defined in claim 22, further wherein:

the depression in the hood element is centrally located in the hood element.

24. The flat-bed knitting machine as defined in claim 22, further comprising:

a plurality of yarn tensioning devices, further wherein:

the carriage apparatus includes a stopping face;

the protective cover includes at least one adjustable stop which cooperates with the stopping face of the carriage apparatus for attaining said outer position; and the tensioning devices and adjustable stops are secure to the skeleton frame.

25. The flat-bed knitting machine as defined in claim 1, further comprising:

a spool table; and a front protective cover, further wherein:

in assembly the protective cover covers on one side a region between the underside of the needle bed apparatus and the underside of the spool table, and on the other side covers a region between the rear edge of the needle bed apparatus and the inside of the front protective cover.

* * * * *

UNITED STATES PATENT AND TRADEMARK OFFICE

CERTIFICATE OF CORRECTION

PATENT NO. : 4,703,630

DATED : November 3, 1987

INVENTOR(S) : Ernst Goller, Udo Herman, Adam Müller and Fritz Walker

It is certified that error appears in the above-identified patent and that said Letters Patent is hereby corrected as shown below:

Column 7, line 39, "material" should be --relative--;

line 51, "from" should be --frame--.

Column 9, line 17, after "and" --a hood element covering the skeleton frame-- should be added.

Column 10, line 12, "secure" should be --secured--.

Signed and Sealed this

Twenty-first Day of June, 1988

*Attest:*

*Attesting Officer*

DONALD J. QUIGG

*Commissioner of Patents and Trademarks*